US010563352B2

(12) United States Patent
Bilodeau et al.

(10) Patent No.: US 10,563,352 B2
(45) Date of Patent: Feb. 18, 2020

(54) ENERGY EFFICIENT PROCESS FOR PREPARING NANOCELLULOSE FIBERS

(71) Applicant: University of Maine System Board of Trustees, Orono, ME (US)

(72) Inventors: Michael A. Bilodeau, Brewer, ME (US); Mark A. Paradis, Old Town, ME (US)

(73) Assignee: University of Maine System Board of Trustees, Orono, ME (US)

( * ) Notice: Subject to any disclaimer, the term of this patent is extended or adjusted under 35 U.S.C. 154(b) by 380 days.

(21) Appl. No.: 14/407,751

(22) PCT Filed: Jun. 13, 2013

(86) PCT No.: PCT/US2013/045640

§ 371 (c)(1),
(2) Date: Dec. 12, 2014

(87) PCT Pub. No.: WO2013/188657

PCT Pub. Date: Dec. 19, 2013

(65) Prior Publication Data

US 2015/0167243 A1 Jun. 18, 2015

Related U.S. Application Data

(60) Provisional application No. 61/659,082, filed on Jun. 13, 2012.

(51) Int. Cl.
*D21C 9/00* (2006.01)
*D21H 11/18* (2006.01)
(Continued)

(52) U.S. Cl.
CPC ..... *D21C 9/007* (2013.01); *D21C 9/002* (2013.01); *D21C 9/004* (2013.01); *D21H 11/18* (2013.01); *D21H 17/005* (2013.01); *D21H 17/63* (2013.01)

(58) Field of Classification Search
CPC ..... D21C 9/001; D21C 9/002; D21C 9/004; D21C 9/005; D21C 9/007
See application file for complete search history.

(56) References Cited

U.S. PATENT DOCUMENTS 4,238,282 A 12/1980 Hyde
4,374,702 A 2/1983 Turbak et al.
(Continued)

FOREIGN PATENT DOCUMENTS

CA 2755706 A1 10/2010
CN 1341125 A 3/2002
(Continued)

OTHER PUBLICATIONS

Henriksson et al., An environmentally friendly method for enzyme-assited preparation of microfibrillated cellulose (MFC) nanofibers, Jun. 2007, European polymer Journal, 43, p. 3434-3441.*
(Continued)

*Primary Examiner* — Anthony Calandra
(74) *Attorney, Agent, or Firm* — MacMillan, Sobanski & Todd, LLC

(57) ABSTRACT

A scalable, energy efficient process for preparing cellulose nanofibers is disclosed. The process employs a depolymerizing treatment with one or both of: (a) a relatively high charge of ozone under conditions that promote the formation of free radicals to chemically depolymerize the cellulose fiber cell wall and interfiber bonds; or (b) a cellulase enzyme. Depolymerization may be estimated by pulp viscosity changes. The depolymerizing treatment is followed by or concurrent with mechanical comminution of the treated fibers, the comminution being done in any of several mechanical comminuting devices, the amount of energy savings varying depending on the type of comminuting system and the treatment conditions. Comminution may be carried out to any of several endpoint measures such as fiber length, % fines or slurry viscosity.

18 Claims, 7 Drawing Sheets

(51) Int. Cl.
*D21H 17/00* (2006.01)
*D21H 17/63* (2006.01)

(56) References Cited

U.S. PATENT DOCUMENTS

| | | | | |
|---|---|---|---|---|
| 5,034,096 | A | 7/1991 | Hammer et al. | |
| 5,387,317 | A | 2/1995 | Parthasarathy et al. | |
| 5,464,501 | A | 11/1995 | Kogan et al. | |
| 5,509,999 | A | 4/1996 | Lindberg | |
| 5,520,783 | A | 5/1996 | White et al. | |
| 5,571,378 | A | 11/1996 | Elofson et al. | |
| 5,593,544 | A | 1/1997 | Fahlgren et al. | |
| 5,656,130 | A | 8/1997 | Ali | |
| 5,658,429 | A | 8/1997 | Andersson et al. | |
| 5,728,264 | A | 3/1998 | Pangalos | |
| 5,755,925 | A | 5/1998 | Kogan et al. | |
| 5,964,983 | A | 10/1999 | Dinand et al. | |
| 6,136,041 | A | 10/2000 | Jaschinski et al. | |
| 6,153,300 | A | 11/2000 | Stromberg et al. | |
| 6,214,163 | B1 | 4/2001 | Matsuda et al. | |
| 6,258,207 | B1 | 7/2001 | Pan | |
| 6,302,997 | B1 | 10/2001 | Hurter et al. | |
| 6,398,908 | B1 | 6/2002 | Hermansson et al. | |
| 6,716,976 | B1 | 4/2004 | Jetten et al. | |
| 7,381,294 | B2 | 6/2008 | Suzuki et al. | |
| 8,338,494 | B2 | 12/2012 | Nachtkamp et al. | |
| 9,051,684 | B2 * | 6/2015 | Hua | D21D 1/20 |
| 2005/0194477 | A1 | 9/2005 | Suzuki | |
| 2007/0131364 | A1 | 6/2007 | Hutto et al. | |
| 2009/0221812 | A1 | 9/2009 | Ankerfors et al. | |
| 2010/0224336 | A1 | 9/2010 | Hutto et al. | |
| 2010/0282422 | A1 | 11/2010 | Miyawaki et al. | |
| 2011/0036522 | A1 | 2/2011 | Ankerfors et al. | |
| 2012/0009661 | A1 | 1/2012 | Miyawaki et al. | |
| 2013/0025807 | A1 * | 1/2013 | Wernersson | D21C 9/002 162/146 |

FOREIGN PATENT DOCUMENTS

| | | | |
|---|---|---|---|
| CN | 101772517 | A | 7/2010 |
| EP | 0554965 | A1 | 8/1993 |
| JP | 2010-254726 | A | 11/2010 |
| JP | 2012193353 | A | 10/2012 |
| WO | 2010116826 | A1 | 10/2010 |

OTHER PUBLICATIONS

Google machine translation of JP2010254726 (cited in IDS) performed on Aug. 24, 2018.*
nanopartikel.info, Nanocellulose and Cellulose nanoparticles, downloaed online Aug. 27, 2018.*
Chinese First Office Action, Application No. 201380038274.3, dated Dec. 11, 2015.
European Extended Search Report, Application No. 13803701.5, dated Jan. 18, 2016.
Ankerfors, "The manufacture of microfibrillated cellulose (MFC) its applications", STFI-Packforsk AB, Nanostructured cellulose and new cellulose derivatives seminar, Nov. 16, 2006, pp. 1-6.
Biermann, "Fig. 18-9. Properties of polymers as a function of average DP.", Handbook of Pulping and Papermaking, 1996, Second Edition, p. 420.
Gullichsen et al., "Chemical Pulping", Papermaking Science and Technology, Book 6A, 1999, pp. A194-A208, A224, A645-654.
Gullichsen et al., "Pulp and Paper Testing", Papermaking Science and Technology, Book 17, 1999, p. 116.
Klemm et al, "Nanocelluloses: A New Family of Nature-Based Materials", Angewandte Chemie International Edition, Jun. 6, 2011, vol. 50, Issue 24, pp. 5438-5466, Abstract Only.
Lind et al., "The chemistry of ozone during pulp bleaching," Journal of Wood Chemistry and Technology, 1997, vol. 17, Issue 3, pp. 297-326, Abstract Only.
PCT International Search Report, Application No. PCT/US2013/045640 dated Oct. 22, 2013.
PCT International Search Report and Written Opinion, Application No. PCT/JP2008/073542 dated Jan. 1, 2010.
Ragauskas, "Basic Pulp Properties", Georgia Tech Institute of Paper Science and Technology, http://ipstgatech.edu/faculty/ragauskas_art/technical_reviews/Pulp%20Properties.pdf , accessed on Feb. 19, 2015.
Saito et al., "TEMPO-Mediated Oxidation of Native Cellulose. The Effect of Oxidation Conditions on Chemical and Crystal Structures of the Water-Insoluble Fractions", Biomacromolecules, 2004, vol. 5, pp. 1983-1989.
Sevastyanova et al., "Bleaching of Eucalyptus Kraft Pulps with Chlorine Dioxide: factors affecting the efficiency of final D stage", 20th IPBC, Portland, Oct. 5-7, 2011.
Simoes et al., "Ozone Delignification of Pine and Eucalyptus Kraft Pulps. 1. Kinetics", Industrial and Engineering Chemical Research, 1999, vol. 38, pp. 4600-4607.
Simoes et al., "Ozone Delignification of Pine and Eucalyptus Kraft Pulps. 2. Kinetics", Industrial and Engineering Chemical Research, 1999, vol. 38, pp. 4608-4614.
Simoes et al., "Ozone Depolymerization of Polysaccharides in Different Materials", Journal of Pulp and Paper Science, 2001, vol. 27, No. 3, pp. 82-87.
Tappi , "Laboratory processing of pulp (beater method)", T 200 om-89, 1989, pp. 1-5.
Tappi , "Viscosity of pulp (capillary viscometer method)", T 230 om-89, 1989, pp. 1-6.
Henriksson et al., "An environmentally friendly method for enzyme-assisted preparation of microfibrillated cellulose (MFC) nanofibers", European Polymer Journal, 2007, vol. 43, pp. 3434-3441.
European Communication of a Third Party-Observation against European Patent Application No. 13803701.5 (EP2861799), dated May 18, 2017.
Japanese Office Action, Application No. JP 2015-517423, dated Feb. 23, 2018.
Canadian Office Action, Application No. 2,876,082, dated Jul. 10, 2019.
Brazilian Preliminary Office Action, Application No. BR112014031092-0, dated Sep. 10, 2019.

* cited by examiner

ENERGY EFFICIENT PROCESS FOR PREPARING NANOCELLULOSE FIBERS

RELATED APPLICATIONS

This application claims priority to U.S. provisional application Ser. No. 61/659,082, filed Jun. 13, 2012 and incorporated herein by reference.

BACKGROUND OF THE INVENTION

The present invention relates generally to the field of cellulosic pulp processing, and more specifically to the processing of cellulosic pulp to prepare nanocellulose fibers, also known in the literature as microfibrillated fibers, microfibrils and nanofibrils. Despite this variability in the literature, the present invention is applicable to microfibrillated fibers, microfibrils and nanofibrils, independent of the actual physical dimensions.

Conventionally, chemical pulps produced using kraft, soda or sulfite cooking processes have been bleached with chlorine-containing bleaching agents. Although chlorine is a very effective bleaching agent, the effluents from chlorine bleaching processes contain large amounts of chlorides produced as the by-product of these processes. These chlorides readily corrode processing equipment, thus requiring the use of costly materials in the construction of bleaching plants. In addition, there are concerns about the potential environmental effects of chlorinated organics in effluents.

To avoid these disadvantages, the paper industry has attempted to reduce or eliminate the use of chlorine-containing bleaching agents for the bleaching of wood pulp. In this connection, efforts have been made to develop a bleaching process in which chlorine-containing agents are replaced, for example, by oxygen-based compounds, such as ozone, peroxide and oxygen, for the purpose of delignifying, i.e. bleaching, the pulp. The use of oxygen does permit a substantial reduction in the amount of elemental chlorine used. However, the use of oxygen is often not a completely satisfactory solution to the problems encountered with elemental chlorine. Oxygen and ozone have poor selectivity, however; not only do they delignify the pulp, they also degrade and weaken the cellulosic fibers. Also, oxygen-based delignification usually leaves some remaining lignin in the pulp which must be removed by chlorine bleaching to obtain a fully-bleached pulp, so concerns associated with the use of chlorine containing agents still persist. US Patent Publications 2007/0131364 and 2010/0224336 to Hutto et al; U.S. Pat. No. 5,034,096 to Hammer, et al; U.S. Pat. No. 6,258,207 to Pan; EP 554,965 A1 to Andersson, et al; U.S. Pat. No. 6,136,041 to Jaschnski et al; U.S. Pat. No. 4,238,282 to Hyde; and others exemplify these oxygen-based approaches.

Problems with these approaches include the need for a chelant and/or highly acidic conditions that sequesters the metal ions that can "poison" the peroxides, reducing their effectiveness. Acidic conditions can also lead to corrosion of machinery in bleaching plants.

The bleaching of pulps however is distinct from and, by itself, does not result in release of nanocellulose fibers. A further mechanical refining or homogenization is typically required, a process that utilizes a great deal of energy, to mechanically and physically break the cellulose into smaller fragments. Frequently multiple stages of homogenization or refining, or both, are required to achieve a nano-sized cellulose fibril. For example, U.S. Pat. No. 7,381,294 to Suzuki et al. describes multiple-step refining processes requiring 10 or more, and as many as 30-90 refining passes.

Another known method to liberate nanofibrils from cellulose fiber is to oxidize the pulp using 2,2,6,6-tetramethylpiperidine-1-oxyl radical ("TEMPO") and derivatives of this compound. US patent publication 2010/0282422 to Miyawaki et al., and Saito and Isogai, *TEMPO—Mediated Oxidation of Native Cellulose: The Effect of Oxidation Conditions on Chemical and Crystal Structures of the Water-Insoluble Fractions*, Biomacromolecules, 2004: 5, 1983-1989, describe this method. However, this ingredient is very expensive to manufacture and use for this purpose. In addition, use of this compound tends to chemically modify the surface of the fiber such that the surface charge is much more negative than native cellulose surfaces. This poses two additional problems: (1) the chemical modifications to cellulose may hinder approval with regulatory agencies such as the FDA in products so-regulated; and (2) the highly negative charge affects handling and interactions with other materials commonly used in papermaking and other manufacturing processes and may need to be neutralized with cations, adding unnecessary processing and expense.

As noted, ozone has been utilized as an oxidative bleaching agent, but it too has been associated with problems, specifically (1) toxicity and (2) poor selectivity for lignin rather than cellulose. These and other problems are discussed in Gullichsen (ed). Book 6A "Chemical Pulping" in Papermaking Science and Technology, Fapet Oy, 1999, pages A194 et seq., incorporated by reference. Additionally, the use of ozone or chemical agents as a bleaching pretreatment followed by a mechanical refining approach to liberate nanofibrils, entails a very high energy cost that is not sustainable on a commercial level.

Thus, it is an object and feature of the invention to provide an oxidative treatment process using ozone that is commercially scalable and requires use of significantly less energy than known methods to liberate nanofibrils from cellulosic fibers. Another advantage flowing from the invention is reduced corrosiveness and better environmental impact due to the avoidance of chlorine compounds.

SUMMARY OF THE INVENTION

In one aspect, the invention comprises an improved process for preparing cellulose nanofibers (also known as cellulose nanofibrils or CNF and as nanofibrillated cellulose (NFC) and as microfibrillated cellulose (MFC)) from a cellulosic material, comprising:

treating the cellulosic material with an aqueous slurry containing a depolymerizing agent selected from (a) ozone at a charge level of at least about 0.1 wt/wt %, based on the dry weight of the cellulosic material for generating free radicals in the slurry; (b) a cellulase enzyme at a concentration from about 0.1 to about 10 lbs/ton based on the dry weight of the cellulosic material; or (c) a combination of both (a) and (b), under conditions sufficient to cause partial depolymerization of the cellulosic material; and concurrently or subsequently comminuting the cellulosic material to liberate cellulose nanofibers;

wherein the overall process achieves an energy efficiency (as defined herein) of at least about 2%.

In some embodiments the treatment step is performed concurrently with the comminution step. In other embodiments, the treatment step is performed prior to the comminution step, making it a "pretreatment" step.

In contrast with prior art pulp bleaching pretreatments using ozone, depolymerization is a desired and intended result, although 100% depolymerization is rarely needed or achieved. In some embodiments the depolymerization is at least about 5%, at least about 8%, at least about 10%, at least about 12%, at least about 15%, at least about 20%, at least about 25%, or at least about 30%. Upper extent of depolymerization is less critical and may be up to about 75%, up to about 80%, up to about 85%, up to about 90% or up to about 95%. For example, depolymerization may be from about 5% to about 95%, from about 8% to about 90%, or any combination of the above-recited lower and upper extents. Alternatively, the treatment step is designed to cause a decrease in viscosity of at least about 5%, at least about 8%, at least about 10%, at least about 12%, at least about 15%, at least about 20%, at least about 25%, or at least about 30%.

In embodiments using ozone, the charge level of ozone may be from about 0.1% to about 40% (wt/wt %), and more particularly from about 0.5% to about 15%, or from about 1.2% to about 10%. In other embodiments the ozone charge level is at least about 1.5%, at least about 2%, at least about 5%, or at least about 10%. In embodiment using cellulase enzymes, the concentration of enzyme may range from about 0.1 to about 10 lbs/ton of dry pulp weight. In some embodiments, the amount of enzyme is from about 1 to about 8 lbs/ton; in other embodiments, the ranges is from about 3 to about 6 lbs/ton. Cellulases may be endo- or exoglucanases, and may comprise individual types or blends of enzymes having different kinds of cellulase activity. In some embodiments, both ozone and enzymes may be used in the depolymerizing treatment.

In some embodiments the depolymerizing treatment may be supplemented with a peroxide. When an optional peroxide (such a hydrogen peroxide) is used, the peroxide charge may be from about 0.1% to about 30% (wt/wt %), and more particularly from about 1% to about 20%, from about 2% to about 10%, or from about 3% to about 8%, based on the weight of dry cellulosic material. When an optional enzyme is used, the enzyme may comprise a single type of cellulase enzyme or a blend of cellulases, such as PERGALASE™.

The nature of comminuting step is not critical, but the amount of energy efficiency gained may depend on the comminution process. Any instrument selected from a mill, a Valley beater, a disk refiner (single or multiple), a conical refiner, a cylindrical refiner, a homogenizer, and a microfluidizer are among those that are typically used for comminution. The endpoint of comminution may be determined any of several ways. For example, by the fiber length (e.g. wherein about 80% of the fibers have a length less than about 0.2 mm); by the % fines; by the viscosity of the slurry; or by the extent of depolymerization.

It has been found advantageously that increasing the depolymerization permits the use of less energy in the comminution step, which creates an energy efficiency. For example, the energy consumption may be reduced by at least about 3%, at least about 5%, at least about 8%, at least about 10%, at least about 15%, at least about 20% or at least about 25% compared to energy consumption for comparable endpoint results without the treatment. In other words, the energy efficiency of the process is improved by at least about 3%, at least about 5%, at least about 8%, at least about 10%, at least about 15%, at least about 20%, at least about 25%, or at least about 30%.

A further aspect of the present invention is paper products made using cellulose nanofibers made by any of the processes described above. Such paper products have improved properties, such as porosity, smoothness, opacity, brightness, and strength.

Other advantages and features are evident from the following detailed description.

BRIEF DESCRIPTION OF THE DRAWINGS

The accompanying drawings, incorporated herein and forming a part of the specification, illustrate the present invention in its several aspects and, together with the description, serve to explain the principles of the invention. In the drawings, the thickness of the lines, layers, and regions may be exaggerated for clarity.

Various aspects of this invention will become apparent to those skilled in the art from the following detailed description of the preferred embodiment, when read in light of the accompanying drawings.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including books, journal articles, published U.S. or foreign patent applications, issued U.S. or foreign patents, and any other references, are each incorporated by reference in their entireties, including all data, tables, figures, and text presented in the cited references.

Numerical ranges, measurements and parameters used to characterize the invention—for example, angular degrees, quantities of ingredients, polymer molecular weights, reaction conditions (pH, temperatures, charge levels, etc.), physical dimensions and so forth—are necessarily approximations; and, while reported as precisely as possible, they inherently contain imprecision derived from their respective measurements. Consequently, all numbers expressing ranges of magnitudes as used in the specification and claims are to be understood as being modified in all instances by the term "about." All numerical ranges are understood to include all possible incremental sub-ranges within the outer boundaries of the range. Thus, a range of 30 to 90 units discloses, for example, 35 to 50 units, 45 to 85 units, and 40 to 80 units, etc. Unless otherwise defined, percentages are wt/wt %.

Cellulosic Materials

Cellulose, the principal constituent of "cellulosic materials," is the most common organic compound on the planet. The cellulose content of cotton is about 90%; the cellulose content of wood is about 40-50%, depending on the type of wood. "Cellulosic materials" includes native sources of cellulose, as well as partially or wholly delignified sources. Wood pulps are a common, but not exclusive, source of cellulosic materials.

Figure 1:
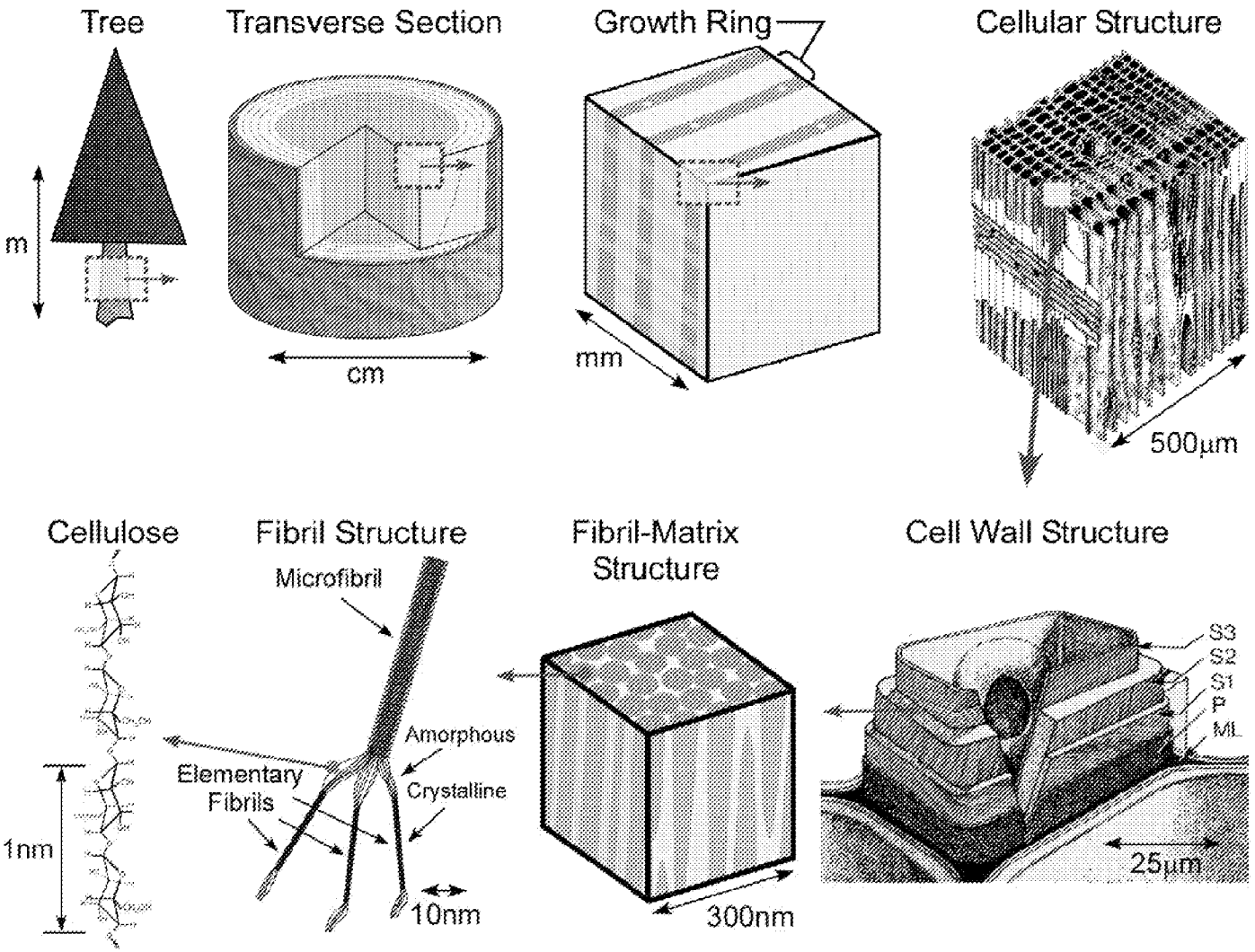
FIG. 1 is a schematic illustration showing some of the components of a cellulosic fiber such as wood.

FIG. 1 presents an illustration of some of the components of wood, starting with a complete tree in the upper left, and, moving to the right across the top row, increasingly magnifying sections as indicated to arrive at a cellular structure diagram at top right. The magnification process continues downward to the cell wall structure, in which S1, S2 and S3 represent various secondary layers, P is a primary layer, and ML represents a middle lamella. Moving left across the bottom row, magnification continues up to cellulose chains at bottom left. The illustration ranges in scale over 9 orders of magnitude from a tree that is meters in height through cell structures that are micron (μm) dimensions, to microfibrils and cellulose chains that are nanometer (nm) dimensions. In the fibril-matrix structure of the cell walls of some woods, the long fibrils of cellulose polymers combine with 5- and 6-member polysaccharides, hemicelluloses and lignin.

As depicted in FIG. 1, cellulose is a polymer derived from D-glucose units, which condense through beta (1-4)-glycosidic bonds. This linkage motif is different from the alpha (1-4)-glycosidic bonds present in starch, glycogen, and other carbohydrates. Cellulose therefore is a straight chain polymer: unlike starch, no coiling or branching occurs, and the molecule adopts an extended and rather stiff rod-like conformation, aided by the equatorial conformation of the glucose residues. The multiple hydroxyl groups on a glucose molecule from one chain form hydrogen bonds with oxygen atoms on the same or on a neighbor chain, holding the cellulose chains firmly together side-by-side and forming elementary nanofibrils. Cellulose nanofibrils (CNF) are similarly held together in larger fibrils known as microfibrils; and microfibrils are similarly held together in bundles or aggregates in the matrix as shown in FIG. 1. These fibrils and aggregates provide cellulosic materials with high tensile strength, which is important in cell walls conferring rigidity to plant cells.

As noted, many woods also contain lignin in their cell walls, which give the woods a darker color. Thus, many wood pulps are bleached and/or degraded to whiten the pulp for use in paper and many other products. The lignin is a three-dimensional polymeric material that bonds the cellulosic fibers and is also distributed within the fibers themselves. Lignin is largely responsible for the strength and rigidity of the plants.

For industrial use, cellulose is mainly obtained from wood pulp and cotton, and largely used in paperboard and paper. However, the finer cellulose nanofibrils (CNF) or microfibrillated cellulose (MFC), once liberated from the woody plants, are finding new uses in a wide variety of products as described below.

General Pulping and Bleaching Processes

Wood is converted to pulp for use in paper manufacturing. Pulp comprises wood fibers capable of being slurried or suspended and then deposited on a screen to form a sheet of paper. There are two main types of pulping techniques: mechanical pulping and chemical pulping. In mechanical pulping, the wood is physically separated into individual fibers. In chemical pulping, the wood chips are digested with chemical solutions to solubilize a portion of the lignin and thus permit its removal. The commonly used chemical pulping processes include: (a) the kraft process, (b) the sulfite process, and (c) the soda process. These processes need not be described here as they are well described in the literature, including Smook, Gary A., Handbook for Pulp & Paper Technologists, Tappi Press, 1992 (especially Chapter 4), and the article: "Overview of the Wood Pulp Industry," Market Pulp Association, 2007. The kraft process is the most commonly used and involves digesting the wood chips in an aqueous solution of sodium hydroxide and sodium sulfide. The wood pulp produced in the pulping process is usually separated into a fibrous mass and washed.

The wood pulp after the pulping process is dark colored because it contains residual lignin not removed during digestion which has been chemically modified in pulping to form chromophoric groups. In order to lighten the color of the pulp, so as to make it suitable for white paper manufacture and also for further processing to nanocellulose or MFC, the pulp is typically, although not necessarily, subjected to a bleaching operation which includes delignification and brightening of the pulp. The traditional objective of delignification steps is to remove the color of the lignin without destroying the cellulose fibers. The ability of a compound or process to selectively remove lignins without degrading the cellulose structure is referred to in the literature as "selectivity."

General MFC Processes

Figure 2A:
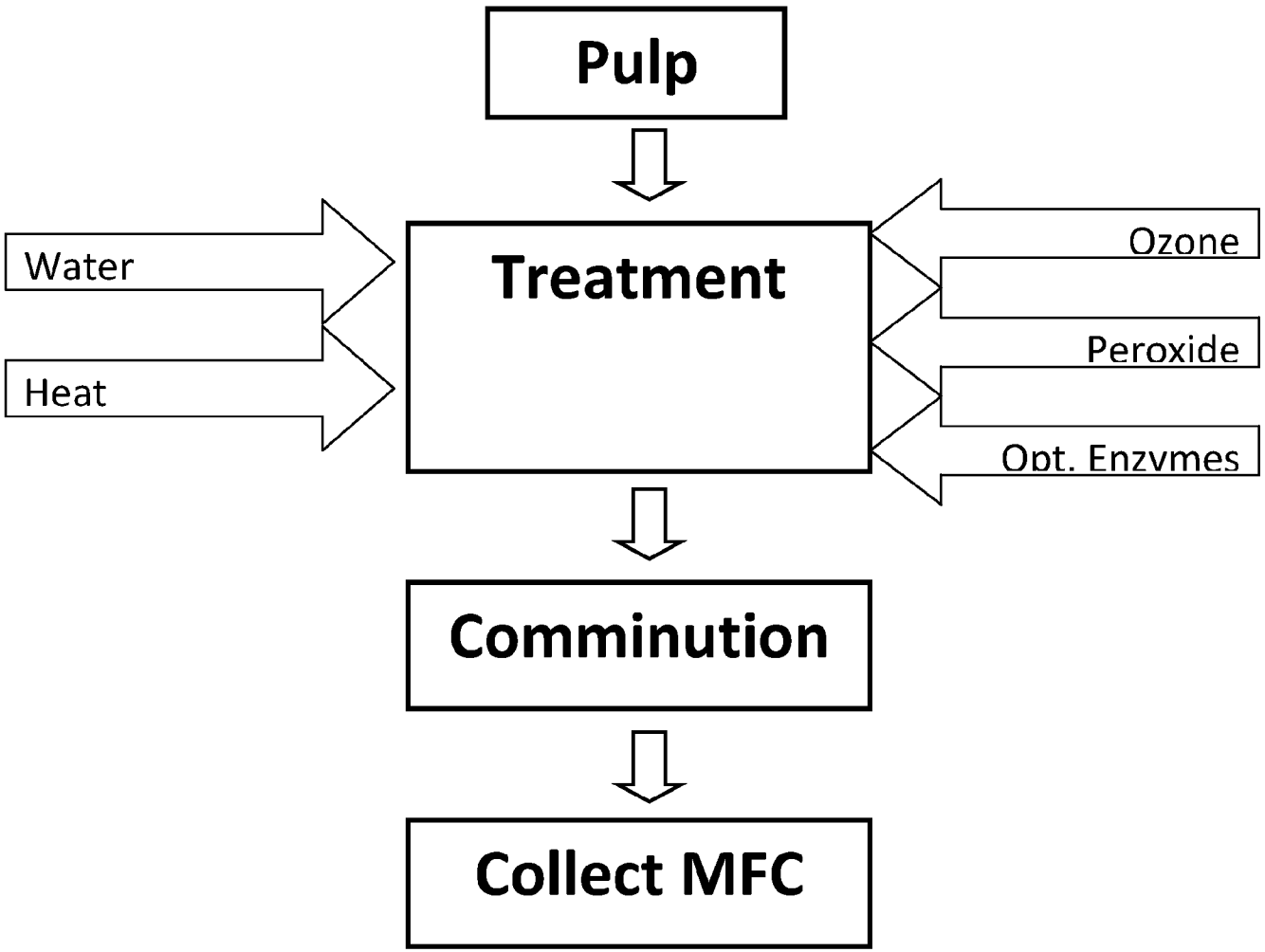
FIGS. 2A and 2B are block diagrams for alternative general process steps for preparing nanocellulose fibers from cellulosic materials.

Referring to FIG. 2A, the preparation of MFC (or CNF) starts with the wood pulp (step 10). The pulp is delignified and bleached as noted above or through a mechanical pulping process which may be accompanied by a treatment step (step 12) and followed by a mechanical grinding or comminution (step 14) to final size. MFC fibrils so liberated are then collected (step 16). In the past, the treatment step 12 has been little more than the bleaching and delignification of the pulp as described above, it being stressed that the selectivity of compounds and processes was important to avoid degrading the cellulose.

However, applicants have found that some amount of depolymerization is desirable since it greatly reduces the overall energy consumed in the comminution step of the process of making nanocellulose fibers. MFCs prepared by this inventive process are particularly well-suited to the cosmetic, medical, food, barrier coatings and other applications that rely less on the reinforcement nature of the cellulose fibers.

Figure 2B:
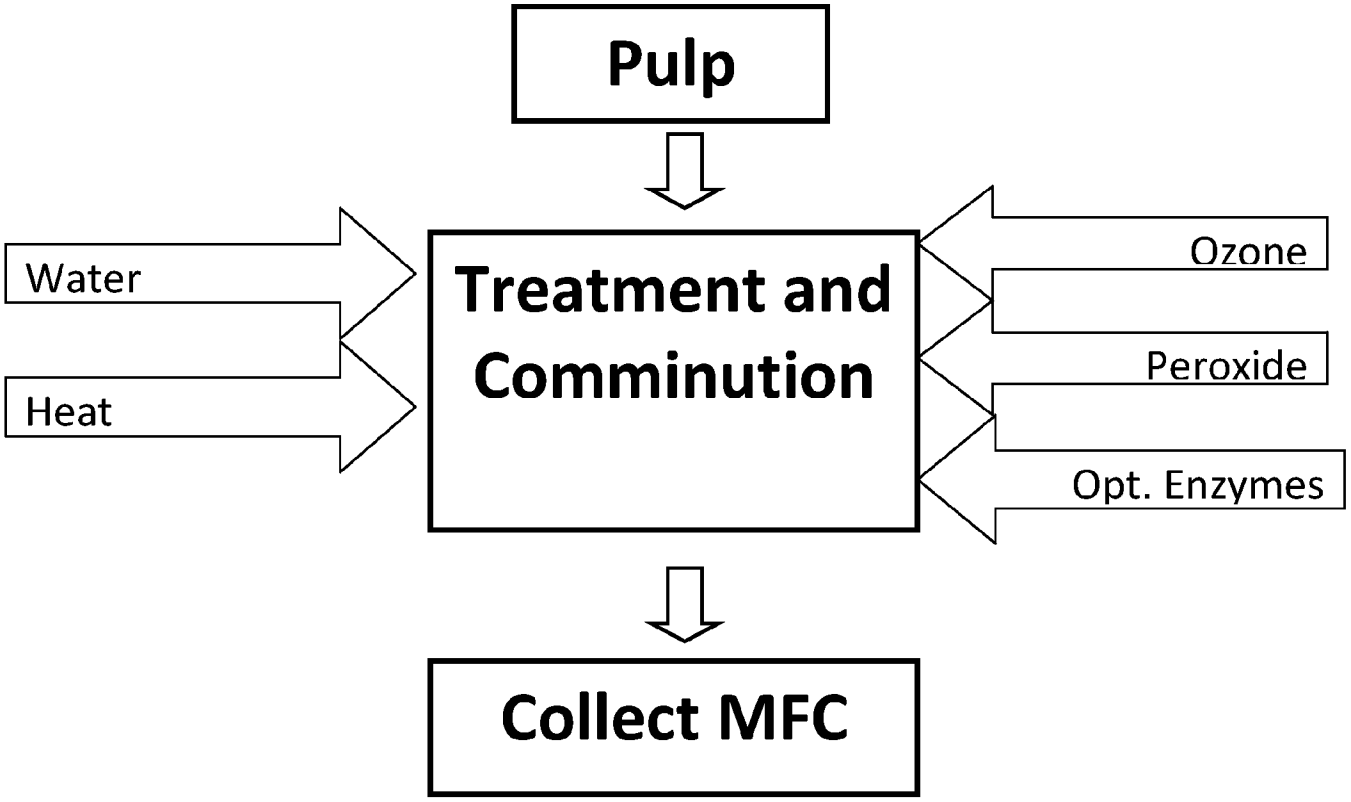

In a variation shown in FIG. 2B, preparation of MFC (or NCF) starts with the wood pulp (step 20). The pulp may be delignified and bleached as noted above. The pulp is then treated concurrently with comminution as shown at step 23 to final size. MFC fibrils (or CNF) so liberated are then collected (step 26). In either variation (the pre-treatment process of FIG. 2A or the concurrent process of FIG. 2B) the treatment and comminution steps may be repeated multiple times.

Degree of Polymerization and the Process of Depolymerization

The degree of polymerization, or DP, is usually defined as the number of monomeric units in a macromolecule or polymer or oligomer molecule. For a homopolymer like cellulose, there is only one type of monomeric unit (glucose) and the number-average degree of polymerization is given by:

$$DP_n = \frac{\text{Total } MW \text{ of the polymer}}{MW \text{ of the monomer unit}} \equiv X_n = \frac{M_n}{M_0}$$

"Depolymerization" is the chemical or enzymatic (as distinct from mechanical breaking) process of degrading the polymer to shorter segments, which results in a smaller DP.

A percent depolymerization is easily calculated as the change from an initial or original DP to a final DP, expressed as a fraction over the original DP×100, i.e. $(DP_i-DP_f)/DP_o\times 100$.

However, in practice, since the MW of the polymer is not easily knowable, the DP is not directly knowable and it is generally estimated by a proxy measurement. One such proxy measurement of DP is pulp viscosity. According to the Mark-Houwink equation, viscosity, [η], and DP are related as:

$$[\eta]=k'\cdot DP^{\alpha}$$

where k and α depend on the nature of the interaction between the molecules and the solvent and are determined empirically for each system.

Figure 5:
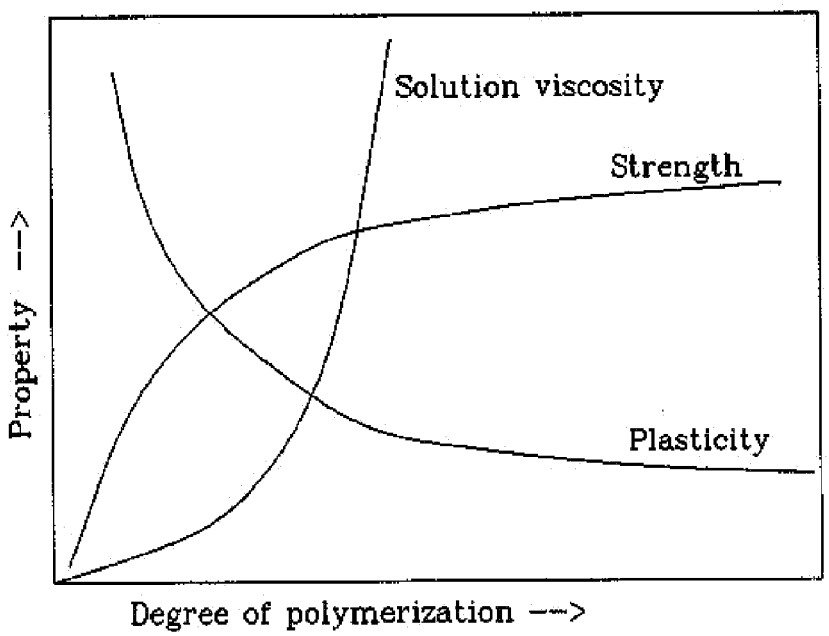
FIG. 5 is simulated chart illustrating how various physical properties of are affected by degree of polymerization.

Thus, pulp viscosity is a fair approximation of DP within similar systems since the longer a polymer is, the more thick or viscous is a solution of that polymer. Viscosity may be measured in any convenient way, such as by Brookfield viscometer. The units for viscosity are generally centipoise (cps). TAPPI prescribes a specific pulp viscosity procedure for dissolving a fixed amount of pulp in a cupriethylene diamine solvent and measuring the viscosity of this solution (See Tappi Test Method T230). A generalized curve showing the relationship between DP and viscosity (and some other properties) is shown in FIG. 5. As with DP, the change in pulp viscosity from initial to final point expressed as a fraction over the initial viscosity is a suitable proxy measure of % depolymerization.

While "pulp viscosity" measures the viscosity of a true solution of fibers in the cupriethylene diamine solvent, the viscosity being impacted by polymer length, a second type of viscosity is also important to the invention. "Slurry viscosity" is a viscosity measure of a suspension of fiber particles in an aqueous medium, where they are not soluble. The fiber particles interact with themselves and the water in varying degrees depending largely on the size and surface area of the particle, so that "slurry viscosity" increases with greater mechanical breakdown and "slurry viscosity" may be used as an endpoint measure, like fiber length and % fines as described below. But it is quite distinct from pulp viscosity.

Figure 6A:
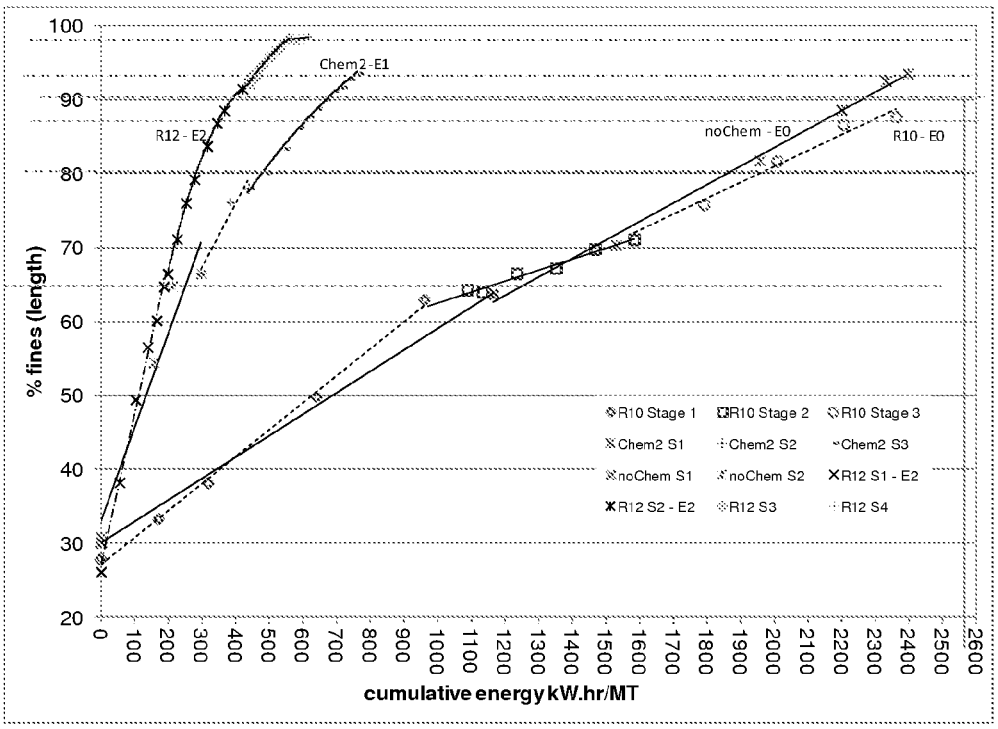
FIGS. 6A and 6B are charts illustrating the energy savings achieved as described in Examples 4 and 5, respectively.
Figure 6B:
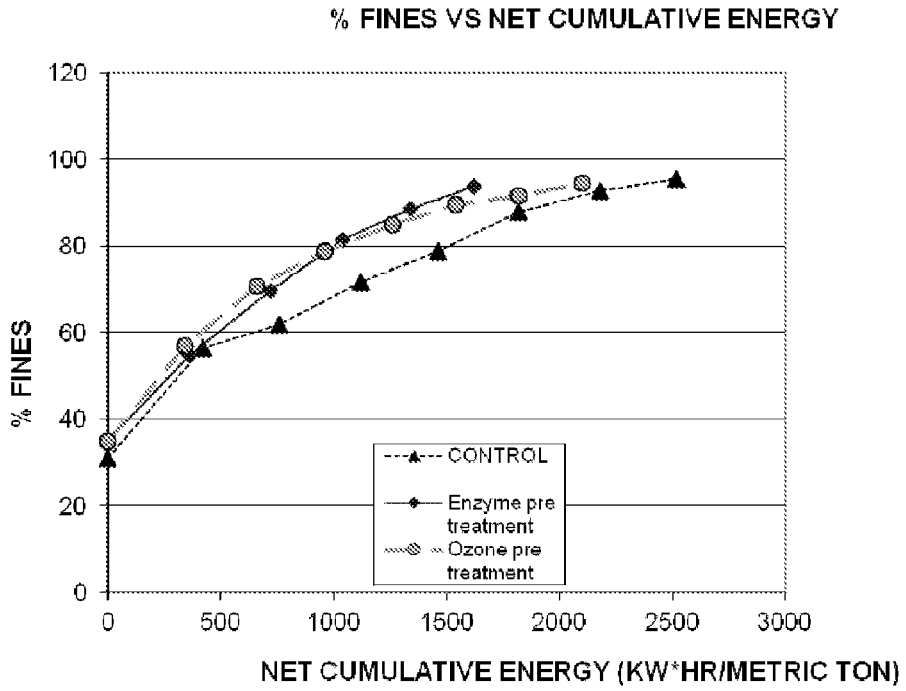
Figure 6C:
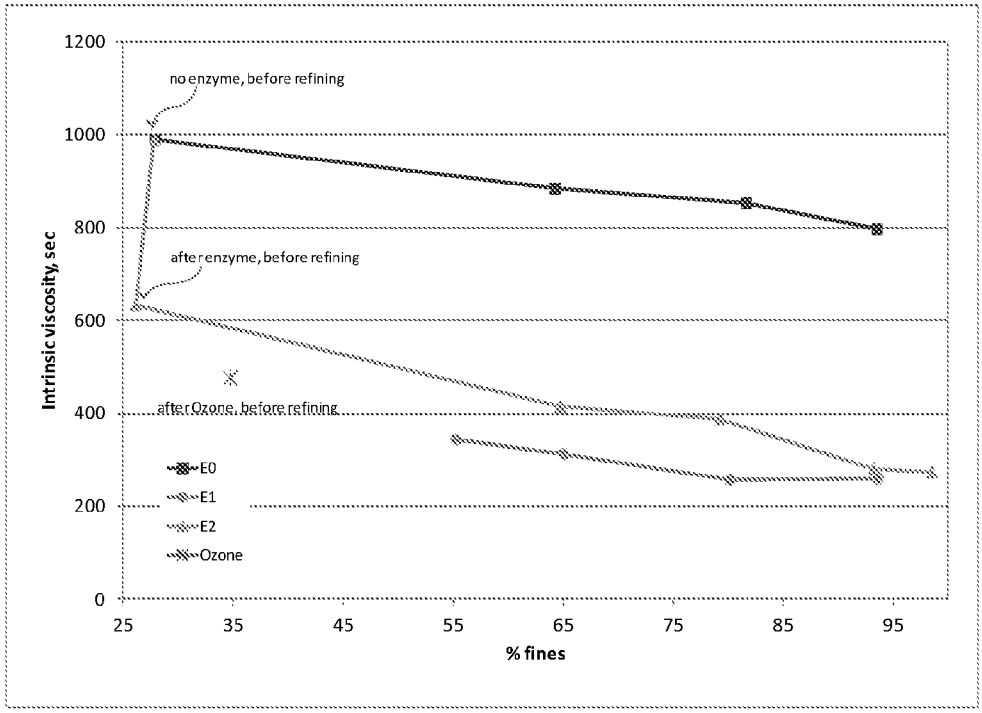
FIG. 6C is a chart of data illustrating the initial or intrinsic viscosity changes caused by various depolymerization treatments.

In accordance with the invention, depolymerization is achieved by a depolymerizing agent selected from ozone or an enzyme. As shown in FIG. 6C, these agents have a profound impact on the intrinsic viscosity which, in turn, greatly impacts the energy needed for refining to nano fibril sizes, as shown in FIGS. 6A and 6B. Notably, traditional mechanical comminution does not impact DP to the same extent as the depolymerization process according to the invention. Nor are prior art oxidative treatments such as bleaching as effective as applicants' invention. Applicants do not wish to be limited to any particular theory of the invention, but this may be due in part to the inability of mechanical processing and prior art chemical processes to enter into cell walls to achieve their degradative effect.

Comminution—Mechanical Breakdown

In a second step of the process, the pretreated fibers are mechanically comminuted in any type of mill or device that grinds the fibers apart. Such mills are well known in the industry and include, without limitation, Valley beaters, single disk refiners, double disk refiners, conical refiners, including both wide angle and narrow angle, cylindrical refiners, homogenizers, microfluidizers, and other similar milling or grinding apparatus. These mechanical comminution devices need not be described in detail herein, since they are well described in the literature, for example, Smook, Gary A., Handbook for Pulp & Paper Technologists, Tappi Press, 1992 (especially Chapter 13). The nature of the grinding apparatus is not critical, although the results produced by each may not all be identical. Tappi standard T200 describes a procedure for mechanical processing of pulp using a beater. The process of mechanical breakdown, regardless of instrument type, is sometimes referred to in the literature as "refining" but we prefer the more generic "comminution."

Figure 3:
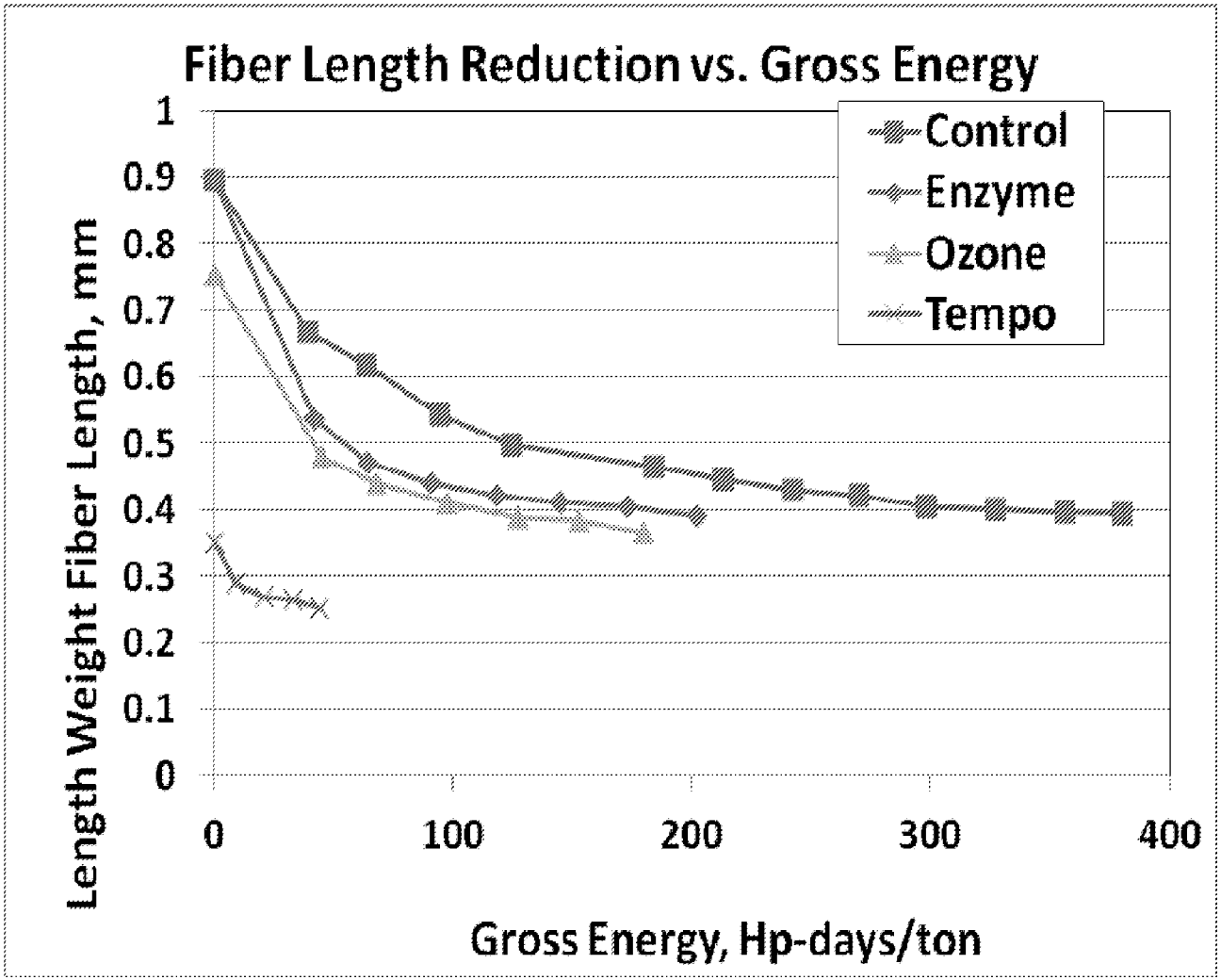
FIGS. 3 and 4 are charts illustrating the energy savings achieved as described in Example 3.
Figure 4:
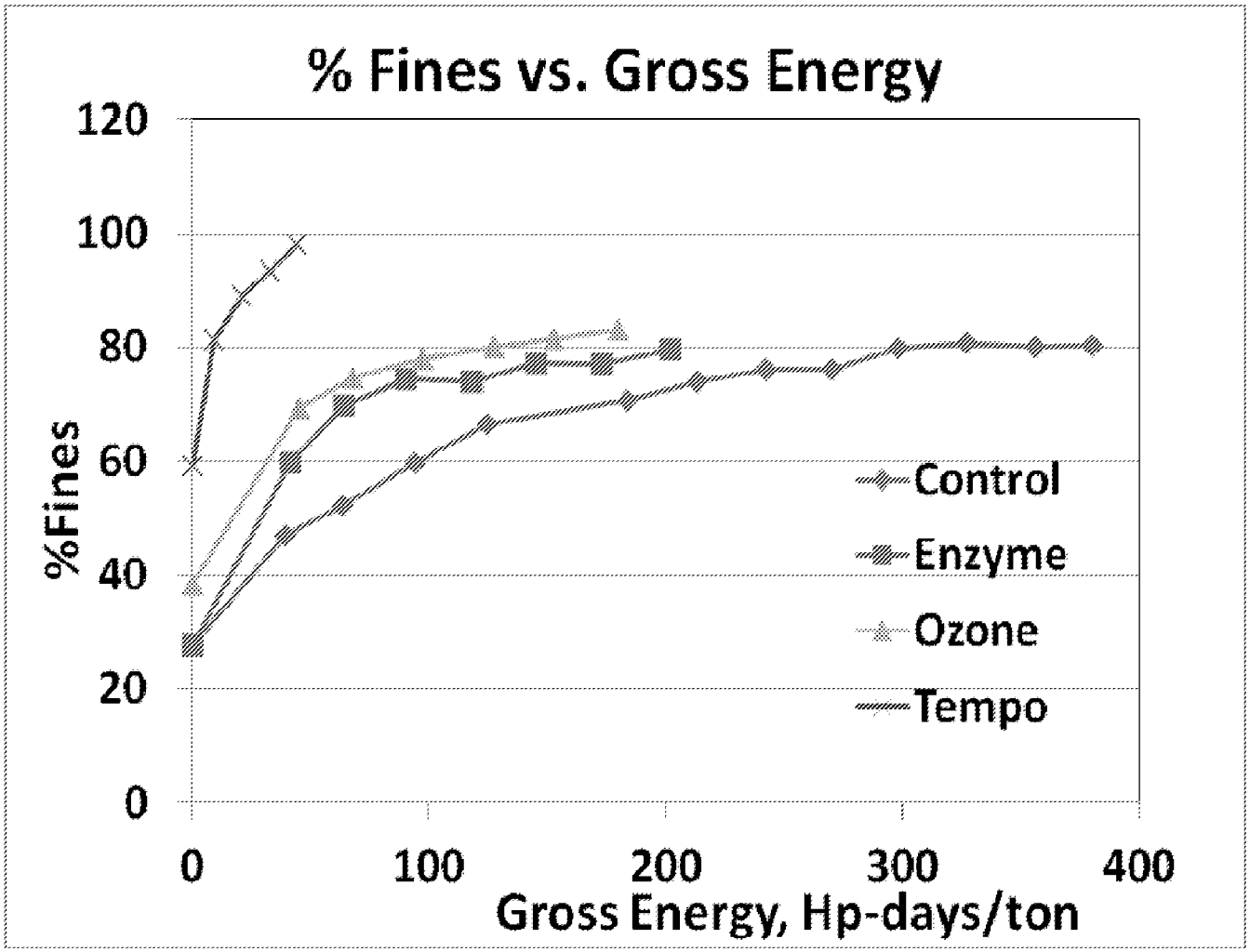

The extent of comminution may be monitored during the process by any of several means. Certain optical instruments can provide continuous data relating to the fiber length distributions and % fines, either of which may be used to define endpoints for the comminution stage. Such instruments are employed as industry standard testers, such as the TechPap Morphi Fiber Length Analyzer. As fiber length decreases, the % fines increases. Example 3 and FIGS. 3 and 4 illustrate this. Any suitable value may be selected as an endpoint, for example at least 80% fines. Alternative endpoints may include, for example 70% fines, 75% fines, 85% fines, 90% fines, etc. Similarly, endpoint lengths of less than 1.0 mm or less than 0.5 mm or less than 0.2 mm or less than 0.1 mm may be used, as may ranges using any of these values or intermediate ones. Length may be taken as average length, median (50% decile) length or any other decile length, such as 90% less than, 80% less than, 70% less than, etc. for any given length specified above. The slurry viscosity (as distinct from pulp viscosity) may also be used as an endpoint to monitor the effectiveness of the mechanical treatment in reducing the size of the cellulose fibers. Slurry viscosity may be measured in any convenient way, such as by Brookfield viscometer.

Energy Consumption and Efficiency Measure

The present invention establishes a process that is sufficiently energy efficient as to be scalable to a commercial level. Energy consumption may be measured in any suitable units. Typically a unit of Power*Hour is used and then normalized on a weight basis. For example: kilowatt-hours/ton (KW-h/ton) or horsepower-days/ton (HP-day/ton), or in any other suitable units. An ammeter measuring current drawn by the motor driving the comminution device is one suitable way to obtain a power measure. For relevant comparisons, either the comminution outcome endpoints or the energy inputs must be equivalent. For example, "energy efficiency" is defined as either: (1) achieving equivalent outcome endpoints (e.g. slurry viscosity, fiber lengths, % fines) with lesser energy consumption; or (2) achieving greater endpoint outcomes (e.g. slurry viscosity, fiber lengths, % fines) with equivalent energy consumption.

As described herein, the outcome endpoints may be expressed as the percentage change; and the energy consumed is an absolute measure. Alternatively the endpoints may be absolute measures and the energies consumed may be expressed on a relative basis as a percentage change. In yet another alternative, both may be expressed as absolute measures. This efficiency concept is further illustrated in the Examples and in FIGS. 3-4 and FIGS. 6A and 6B. An untreated control would have the largest DP, whereas various treatments would impact DP in varying degrees. The treatment combination of enzymes plus ozone is expected to produce the greatest reduction in DP, but either alone produces satisfactory results.

The treatment according to the invention desirably produces energy consumption reductions of at least about 2%, at least about 5%, at least about 8%, at least about 10%, at least about 15%, at least about 20% or at least about 25% compared to energy consumption for comparable endpoint results without the treatment. In other words, the energy efficiency of the process is improved by at least about 2%, at least about 5%, at least about 8%, at least about 10%, at least about 15%, at least about 20%, at least about 25%, or at least about 30%.

As is known in the art, the comminution devices require a certain amount of energy to run them even under no load. The energy consumption increases dramatically when the comminution device is loaded with pulp, but less drastically if the pulp is pretreated in accordance with the invention. The gross energy consumed is the more relevant measure, but it is also possible to subtract the "no-load" consumption to arrive at a net energy consumed for comminution.

Treatments

Treatments with a depolymerizing agent include (a) "pretreatments" that are conducted for a time period prior to comminution, (b) "concurrent" treatments that are conducted during comminution, and (c) treatments that both begin as pretreatments but continue into comminution stage. Depolymerizing treatments according to the invention include ozone alone or enzymes alone or a combination of both, optionally with peroxide in each case. The process of the invention may be applied to bleached or unbleached pulps of a wide variety of hardwoods and/or softwoods. The treatment step is designed to cause depolymerization of at least about 5%, at least about 8%, at least about 10%, at least about 12%, at least about 15%, at least about 20%, at least about 25%, or at least about 30% compared to the initial starting pulp. Alternatively, the treatment step is designed to cause a decrease in slurry viscosity of at least about 5%, at least about 8%, at least about 10%, at least about 12%, at least about 15%, at least about 20%, at least about 25%, or at least about 30% compared to the initial starting pulp slurry.

Ozone

Although ozone has been used in the past as a bleaching agent/delignifier, its used has been limited. Its toxicity has already been noted. Gullichsen observes, at page A196 for example, that ozone works best at a very low pH of about 2 and exhibits best selectivity in the narrow temperature range of 25-30 C. It is generally believed that ozone delignifies by generation of free radicals that combine with the phenols of lignin. Unfortunately for selectivity, these free radicals also attack carbohydrates like cellulose.

In an ozone treatment stage of the process, the wood pulp is contacted with ozone. The ozone is applied to the pulp in any suitable manner. Typically, the pulp is fed into a reactor and ozone is injected into the reactor in a manner sufficient for the ozone to act on the pulp. In some embodiments, a bleaching "stage," although not required, may consist of a mixer to mix the ozone and pulp, and a vessel to provide retention time for a treatment reaction to come to completion, followed by a pulp washing step. Any suitable equipment can be used, such as any suitable ozone bleaching equipment known to those skilled in the art.

For example, the treatment reactor can comprise an extended cylindrical vessel having a mixing apparatus extending in the interior along the length of the vessel. The reactor can have a pulp feed port on one end of the vessel and a pulp outlet port on the opposite end. The pulp can be fed to the reactor in any suitable manner, for example, it can be fed under pressure through a shredder which functions as a pump. The reactor can also have one or more gas feed ports for feeding the ozone gas at one end of the vessel and one or more gas outlet ports for removing gas after reaction at the opposite end of the vessel. In this way the ozone gas may be "bubbled" through the reaction vessel. In certain embodiments, the pulp and ozone are fed in opposite directions through the vessel (countercurrent), but in other embodiments they could be fed in the same direction (co-current).

The treatment process can include ozone as the sole depolymerization agent or the ozone can be used in a mixture with another agent. In certain embodiments, the process is conducted without the addition of a peroxide bleaching agent; however, peroxides may be formed as a by-product during the process. When ozone is used as the sole delignification agent, this does not exclude byproducts of the reaction; for example, the gas removed after the reaction of ozone with pulp may comprise mostly carbon dioxide. In certain embodiments, the ozone is fed to the reactor as the sole gas in the feed stream, but in other embodiments, the ozone is fed along with a carrier gas such as oxygen. It is theorized that delivery of high concentrations of ozone in a gaseous state facilitate entry into cell walls where the formation of free radicals is able to more effectively carry out the depolymerization process.

While ozone may be the sole treatment agent, in some embodiments, the ozone is used with a secondary agent, such as a peroxide or enzymes, or both.

Generally higher charge levels of ozone can be used in the ozone treatment stage. In certain embodiments, the ozone charge during the treatment stage is within a range of from about 0.1% to about 40%, and more particularly from about 0.5% to about 15%, or from about 1.2% to about 10%. In other embodiments the ozone charge level is at least about 1.5%, at least about 2%, at least about 5%, or at least about 10%. The ozone charge is calculated as the weight of the ozone as a percentage of the dry weight of the wood fibers in the pulp.

The ozone treatment stage can be conducted using any suitable process conditions. For example, in certain embodiments the pulp is reacted with the ozone for a time within a range of from about 1 second to about 5 hours, or more specifically from about 10 seconds to about 10 minutes. Also, in certain embodiments, the pulp is reacted with the ozone at a temperature within a range of from about 20° C. to about 80° C., more typically from about 30° C. to about 70° C., or from about 40° C. to about 60° C. In other embodiments, the temperature is at least about 25° C., at least about 30° C., at least about 35° C. or at least about 40° C. There may be no upper limit to the temperature range unless enzymes are also employed, in which case temperatures above about 70° C. may tend to denature the enzymes. Further, in certain embodiments, the pH of the pulp at the end of the bleaching stage is within a range of from about 5 to about 10, and more particularly from about 6 to about 9. It is an advantage of the present invention that it does not require acidic conditions, as did most prior art oxygen/ozone bleaching conditions.

Peroxides

In some embodiments, a peroxide may optionally be used in combination with the ozone as a secondary treatment agent. The peroxides also assist in formation of free radicals. The peroxide may be, e.g. hydrogen peroxide. The peroxide charge during the treatment stage is within a range of from about 0.1% to about 30%, and more particularly from about 1% to about 20%, from about 2% to about 10%, or from about 3% to about 8%, based on the dry weight of the wood pulp.

Enzymes

In some embodiments, one or more cellulase enzymes may be used in combination with the ozone in the treatment process. Cellulase enzymes act to degrade celluloses and may be useful as optional ingredients in the treatment.

Cellulases are classified on the basis of their mode of action. Commercial cellulase enzyme systems frequently contain blends of cellobiohydrolases, endoglucanases and/or beta-D-glucosidases. Endoglucanases randomly attack the amorphous regions of cellulose substrate, yielding mainly higher oligomers. Cellobiohydrolases are exoenzymes and hydrolyze crystalline cellulose, releasing cellobiose (glucose dimer). Both types of exo enzymes hydrolyze beta-1,4-glycosidic bonds. B-D-glucosidase or cellobiase converts cellooligosaccharides and cellobiose to the monomeric glucose. Endoglucanases or blends high in endoglucanase activity may be preferred for this reason. Some commercially available cellulase enzymes include: PERGALASE® A40, and PERGALASE® 7547 (available from Nalco, Naperville, Ill.), FRC (available from Chute Chemical, Bangor, Me.), and INDIAGE™ Super L (duPont Chemical, Wilmington, Del.). Either blends of enzymes or individual enzymes are suitable. Ozone treatment in combination may also improve the effectiveness of enzymes to further hydrolyze fiber bonds and reduce the energy needed to liberate nanofibrils.

The amount of enzyme necessary to achieve suitable depolymerization varies with time and temperature. Useful ranges, however, are from about 0.1 to about 10 lbs/ton of dry pulp weight. In some embodiments, the amount of enzyme is from about 1 to about 8 lbs/ton; in other embodiments, the ranges is from about 3 to about 6 lbs/ton.

Industrial Uses of Nanocellulose Fibers

Nanocellulose fibers still find utility in the paper and paperboard industry, as was the case with traditional pulp. However, their rigidity and strength properties have found myriad uses beyond the traditional pulping uses. Cellulose nanofibers have many advantages over other materials: they are natural and biodegradable, giving them lower toxicity and better "end-of-life" options than many current nanomaterials and systems; their surface chemistry is well understood and compatible with many existing systems; and they are commercially scalable. For example, coatings, barriers and films can be strengthened by the inclusion of nanocellulose fibers. Composites and reinforcements that might traditionally employ glass, mineral, ceramic or carbon fibers, may suitably employ nanocellulose fibers instead.

The high surface area of these nanofibers makes them well suited for absorption and imbibing of liquids, which is a useful property in hygienic and medical products, food packaging, and in oil recovery operations. They also are capable of forming smooth and creamy gels that find application in cosmetics, medical and food products.

EXAMPLES

The following examples serve to further illustrate the invention.

Example 1: Preparation of Comparative Samples

Kraft process pulp samples of bleached hardwood (Domtar Aspen) were prepared and processed by various methods described in this example.

TABLE 1

Sample Preps

| Sample | Treatment | Comminution |
|---|---|---|
| 1 | none, control | none, control |
| 2 | none | refined in a Valley Beater |
| 3 | enzymes | refined in a Valley Beater |

TABLE 1-continued

Sample Preps

| Sample | Treatment | Comminution |
|---|---|---|
| 4 | none, control | none, control |
| 5 | ozone | refined in a Valley Beater |
| 6 | TEMPO | none |
| 7 | TEMPO | refined in a Valley Beater |

Two samples (samples 1 and 4) are the unrefined pulp samples as purchased, with no treatment or refining. Sample 2 is refined but not pretreated. All refined samples are treated in a Valley Beater according to Tappi Standard T200. Sample 3 was pretreated with enzymes (Pergalase™ A40 enzyme blend) according to the Pergalase™ recommended procedure. Sample 5 was pretreated with ozone at a relatively high charge level of 2% and peroxide at a charge level of 5% (both based on dry weight of the fiber) for 15 minutes at a temperature of about 50° C. and a pH of about 7. The ozone was bubbled into the reactor. Samples 6 and 7 were pretreated with 2,2,6,6-tetramethylpiperidine-1-oxyl radical ("TEMPO") according to the procedure of Isogai, Biomacromolecules, 2004: 5, 1983-1989, incorporated by reference. Following pre-treatment, each of the pulps from samples 3, 5, 6 and 7 were extracted and subjected to mechanical refining in the Valley Beater as noted.

Example 2: Charge and Conductivity Testing

The charge and conductivity of each sample was measured using a Mütek PCD-03 instrument according to its standard instructions. The results are in Table 2 below.

TABLE 2

Charge and conductivity

| Sample | Treatment | Mutek (meq/dry gram pulp) | conductivity (mS/cm) |
|---|---|---|---|
| 1 | none, control | −2 | 110 |
| 2 | none | −11 | 105 |
| 3 | enzymes | −13 | 260 |
| 4 | none, control | −0.9 | 105 |
| 5 | ozone | −11 | 270 |
| 6 | TEMPO | −270 | 502 |
| 7 | TEMPO | −280 | 560 |

This data confirms the previously noted problem associated with the TEMPO treatment, i.e. the high negative charge associated with the chemically modified cellulose, which also results in high electrical conductivity. All other samples, including the ozone treated sample according to the invention, have far less negative charge and conductivity.

Example 3: Energy Consumption Testing

The energy consumed in order to refine each MFC was monitored along with % fines and average fibril length as the comminution proceeded. An ammeter connected to the Valley beater drive motor provided the power measurement for energy consumption and the TechPap Morphi Fiber Length Analyzer provided a continuous measure of the % fines and fiber length as endpoint outputs. As seen in table 1, Sample Nos. 2, 3, 5 and 7 were refined. This experiment allows a calculation of the energy efficiency of each of the several treatment processes—i.e. the amount of energy required to reach a specified endpoint or, conversely, the endpoint that can be achieved with a fixed amount of energy consumed. The data are presented in FIGS. 3-4.

FIG. 3 illustrates the reduction of fiber length as a function of the gross energy consumed. From this it can be seen that both the enzyme treatment (#3) and the ozone treatment (#5) are more energy efficient than the control (#2), the ozone being slightly more efficient than the enzymes. The TEMPO treatment (#7) was even more energy efficient, but produces the charge, conductivity, chemical modification and cost problems already discussed above and shown in Example 2.

FIG. 4 confirms the same result using the % fines endpoint measure. The enzyme treatment and the ozone treatment are approximately comparable and both are more energy efficient that the control, but less efficient that the TEMPO sample.

Example 4: Comminution with a Disk Refiner

These trials demonstrate the effects of chemical pretreatments on reducing energy requirements during the production of cellulosic nanofibrils. The trials were conducted in a 20 inch disk refiner using multiple refining stages. Three pulp types were tested, untreated softwood kraft (two trials performed)(E0), Enzyme 1 (E1) pretreatment (Nalco Pergalase 7547) and Enzyme 2 (E2) pretreatment (Chute Chemical FRC). Each enzyme treatment was performed at a pH range of 5.5-6 and a temperature of 50 C. The treatment time for each was 2 hrs prior to refining. The dosage of enzyme for each pretreatment was 4 lbs/ton of pulp. For each trial, periodic samples were collected and measured for % fines content using a TechPap fiber length analyzer. The fines content were plotted as a function of net energy. FIG. 6A summarizes these results, and shows a significant energy reduction using a chemical pretreatment.

Example 5: Comminution with Bench Grinder

These trials again demonstrate the energy reduction of chemical pretreatment for the production of cellulosic nanofibrils. These trials were performed using a bench top grinder (super mass colloider) manufactured by Masuko. The three pulps tested in these trials were untreated softwood kraft pulp (control), an enzyme treated pulp and an ozone treated pulp. For the enzyme pretreatment, the pulp was heated to 50 C and treated with 4 lbs/ton of Chute FRC. The pH and reaction time were 5.5 and 2 hrs respectively. For the ozone pretreatment, softwood pulp at 33% solids was heated to 50 C in a Quantum reactor. The chemistry consisted of 75 ppm of Iron sulfate, 5% hydrogen peroxide and 4% ozone for a reaction time of 30 minutes. As in Example 4, data for fines content as a function of gross energy was collected for each trial. The data are present in FIG. 6B and show a reduction in energy to achieve a given fines level with the use of a pretreatment.

Example 6: Depolymerization Treatments and Viscosity

Using enzymes (E1) and (E2) as described in Example 4 above, along with ozone (prerefining stage only) as depolymerizing treatments along with a control (E0), pulp samples were then refined to about 95% fines as determined by the TechPap fiber length analyzer. This example shows the change intrinsic viscosity as affected by the pretreatment as well as during the refining process. The intrinsic viscosity is an indication of the degree of polymerization of the cellulose chain. FIG. 6C summarizes the change in intrinsic viscosity for each type of pretreatment compared to the untreated pulp. Notably, both enzyme treatments and the ozone treatment caused significant depolymerization, significantly reducing the initial viscosity. Refining decreased viscosity somewhat, but not nearly as dramatically as the depolymerizing treatments.

Further evidence of the weakening of the fibers during pretreatment is shown by measuring the wet zero span tensile strength of each pulp. The wet zero span tensile strength was measured with a Pulmac tester. Table 1 presents the wet zero span tensile data and intrinsic viscosity for pulps treated with either enzyme or ozone compared to an untreated pulp sample. Both chemical treatment samples showed reduced wet zero span tensile strength.

TABLE 3

Initial viscosity and wet zero span tensile strength

| | Intrinsic Viscosity $sec^{-1}$ | Zero-span Tensile psi |
|---|---|---|
| Control pulp, before refining | 989 | 35.15 |
| After enzyme treatment, before refining | 633 | 20.18 |
| After ozone treatment, before refining | 477 | 19.33 |

Example 7: Paper Properties

This example shows some paper property improvements when nano cellulose is added to the paper composition. For this work hand sheets were formed using appropriate TAPPI standards using a hardwood (maple) pulp refined to freeness (CSF) of 425 ml. For each set of hand sheets, the loading of nano cellulose was set at 10% of the total sheet weight. For purpose of comparison, a control set of hand sheets was produced without nano cellulose. A total of five nano cellulose samples were tested. These include three samples without any depolymerizing treatment produced at varying fines levels, one enzyme-treated sample and one ozone-treated sample. All nano cellulose samples were produced using the bench top grinder as in Example 5. The data present in table 4 show a significant increase in Gurley porosity (reduced air flow) and increase in internal bond strength with the addition of nano cellulose. At an equivalent fines level, paper formed with nano cellulose that was pretreated with ozone resulted in the highest porosity and internal bond.

TABLE 4

Improved properties of papers

| sample | Gurley Porosity sec | Sheffield Smoothness cc/min | Brightness ISO | Opacity ISO | Caliper mm | Internal Bond ft-lb/ 1000 in2 |
|---|---|---|---|---|---|---|
| Control | 6.3 | 161 | 87.04 | 82.81 | 0.101 | 37 |
| No Treatment 60% fines | 26.8 | 127 | 88.8 | 80.17 | 0.101 | 71 |
| No Treatment 80% fines | 70.68 | 86 | 89.01 | 79.88 | 0.095 | 94 |

TABLE 4-continued

| Improved properties of papers | | | | | | |
|---|---|---|---|---|---|---|
| sample | Gurley Porosity sec | Sheffield Smoothness cc/min | Brightness ISO | Opacity ISO | Caliper mm | Internal Bond ft-lb/ 1000 in2 |
| No Treatment 93% fines | 118.8 | 73 | 88.76 | 79.61 | 0.092 | 107 |
| Enzyme Treatment 93% fines | 77.12 | 82 | 89.01 | 79.5 | 0.095 | 93 |
| $O_3$ treatment 93% fines | 149.8 | 67 | 88.81 | 72.23 | 0.089 | 132 |

The foregoing description of the various aspects and embodiments of the present invention has been presented for purposes of illustration and description. It is not intended to be exhaustive or all embodiments or to limit the invention to the specific aspects disclosed. Obvious modifications or variations are possible in light of the above teachings and such modifications and variations may well fall within the scope of the invention as determined by the appended claims when interpreted in accordance with the breadth to which they are fairly, legally and equitably entitled.

What is claimed is:

1. A process for forming cellulose nanofibers from a cellulosic material, comprising:

providing a source of cellulosic material in an aqueous slurry;

depolymerizing the cellulosic material in a treatment step with a depolymerizing agent comprising ozone and excluding peroxides at a charge level of from about 1.2 wt/wt % to 10 wt/wt %, based on the dry weight of the cellulosic material for generating free radicals in the aqueous slurry, under conditions sufficient to cleave beta (1-4) glycosidic bonds to cause at least about 20% depolymerization of the cellulosic material; and concurrently or subsequently comminuting the cellulosic material to liberate cellulose nanofibers having a median length of 0.2 mm or less;

wherein the overall process achieves an energy efficiency of at least about 2%, where energy efficiency is defined as either: (1) achieving equivalent comminution outcome endpoints with lesser energy consumption; or (2) achieving a greater comminution endpoint outcome with equivalent energy consumption, wherein the comminution outcome endpoint is selected from slurry viscosity, fiber length or % fines; and wherein the treatment step is carried out at a pH of about 5 to about 10.

2. The process of claim 1 wherein the treatment step is carried out as a pretreatment step prior to the comminuting step.

3. The process of claim 1 wherein the treatment step is carried out at a temperature from about 30° C. to about 70° C.

4. The process of claim 1 further comprising adding to the aqueous slurry one or more enzymes for digesting cellulose.

5. The process of claim 1 wherein the comminuting step is performed by an instrument selected from a mill, a Valley beater, a disk refiner (single or multiple), a conical refiner, a cylindrical refiner, a homogenizer, and a microfluidizer.

6. The process of claim 1 wherein the comminuting step is performed until at least about 80% of the fibers have a length less than about 0.2 mm.

7. The process of claim 1 wherein the treatment is a pretreatment and is conducted under conditions sufficient to cause at least about 25% depolymerization of the cellulosic material.

8. The process of claim 7 wherein the treatment is conducted under conditions sufficient to cause at least about 30% depolymerization of the cellulosic material.

9. The process of claim 1 wherein, for equivalent comminution outcome endpoints, the energy consumption is reduced by at least about 3%.

10. The process of claim 9 wherein the energy consumption is reduced by at least about 8%.

11. The process of claim 1 wherein, for equivalent energy inputs, the comminution achieved is at least 5% higher.

12. The process of claim 11 wherein the comminution achieved is at least 8% higher.

13. The process of claim 1 wherein the energy efficiency achieved is at least about 3%.

14. The process of claim 1 wherein the depolymerizing agent is ozone at a charge level of at least 1.5 wt/wt %.

15. The process of claim 1 wherein the depolymerizing agent is ozone at a charge level of at least 2.0 wt/wt %.

16. A process for forming cellulose nanofibers from a wood pulp, comprising:

providing a wood pulp in an aqueous slurry;

depolymerizing the wood pulp with a depolymerizing agent comprising ozone and excluding peroxides at a charge level of from about 1.2 wt/wt % to about 10 wt/wt %, based on the dry weight of the wood pulp under conditions sufficient to break beta (1-4) glycosidic bonds and cause at least about 20% depolymerization of the wood pulp; and concurrently or subsequently comminuting the wood pulp to a comminution endpoint of at least 80% fines, to liberate cellulose nanofibers;

wherein the overall process achieves an energy efficiency of at least about 2%, where energy efficiency is defined as either: (1) achieving equivalent comminution outcome endpoints with lesser energy consumption; or (2) achieving a greater comminution endpoint outcome with equivalent energy consumption; and wherein the depolymerizing is carried out at a pH of from about 5 to about 10.

17. The process of claim 16, further comprising comminuting the wood pulp to liberate cellulose nanofibers wherein at least 70% of the fibers have a length of 0.2 mm or less.

18. A process for forming cellulose nanofibers from a cellulosic material, comprising:

providing a source of cellulosic material in an aqueous slurry;

depolymerizing the cellulosic material with a depolymerizing agent comprising ozone and excluding peroxides at a charge level of from about 1.2 wt/wt % to about 10 wt/wt %, based on the dry weight of the cellulosic material for generating free radicals in the aqueous slurry, under conditions sufficient to cleave beta (1-4) glycosidic bonds to cause at least about 20% depolymerization of the cellulosic material, wherein the depolymerizing is carried out at a pH of from about 5 to about 10; and concurrently or subsequently comminuting the cellulosic material to liberate cellulose nanofibers having a median length of 0.2 mm or less.

* * * * *